United States Patent [19]

Corrigan

[11] Patent Number: 4,925,097

[45] Date of Patent: May 15, 1990

[54] MISTING SYSTEM

[75] Inventor: John E. Corrigan, Glenview, Ill.

[73] Assignee: Carrot Top, Inc., Northbrook, Ill.

[21] Appl. No.: 356,524

[22] Filed: May 25, 1989

[51] Int. Cl.[5] ..... B05B 1/30

[52] U.S. Cl. ..... 239/73; 137/887; 239/538; 239/562; 239/581.1; 251/345

[58] Field of Search ..... 239/73, 74, 538, 539, 239/579, 581.1, 562, 587; 137/887; 251/341, 345

[56] References Cited

U.S. PATENT DOCUMENTS

| | | | |
|---|---|---|---|
| 414,346 | 11/1889 | Wainwright | 239/538 |
| 792,124 | 6/1905 | Evans | 137/887 |
| 1,197,044 | 9/1916 | McElroy | 251/345 |
| 2,683,626 | 7/1954 | Wahlin | 239/587 |
| 2,788,244 | 4/1957 | Gilmour | 239/73 |
| 3,270,966 | 9/1966 | Ackley | 239/587 |
| 3,517,888 | 6/1970 | Mitterer | 239/579 |
| 3,826,431 | 7/1974 | Telge | 239/562 |
| 4,438,884 | 3/1984 | O'Brien et al. . | |

FOREIGN PATENT DOCUMENTS

| | | | |
|---|---|---|---|
| 809270 | 2/1937 | France | 239/587 |

*Primary Examiner*—Andres Kashnikow
*Assistant Examiner*—Michael J. Forman
*Attorney, Agent, or Firm*—Wood, Phillips, Mason, Recktenwald & Vansanten

[57] ABSTRACT

A misting head assembly including a cylindrical rotor having a chordal flat, a center post having a flow passage, a swivel arm having a tubular portion with a radial through opening mounted for swiveling about the rotor and a connecting portion. The swivel arm connecting portion is adapted for removable mounting of a spray nozzle thereto. The rotor flat defines with the center post housing portion and swivel arm tubular portion a longitudinal flow passage for conducting water from the center post to the swivel arm opening to be sprayed outwardly therefrom through the nozzle when the swivel arm is aligned with the chordal flat of the rotor. In one embodiment, seals are provided for sealingly preventing flow of water from the longitudinal flow passage when the swivel arm is swung from alignment with the chordal flat. An indicium is provided on one end of the rotor for indicating the open position of the nozzle.

23 Claims, 2 Drawing Sheets

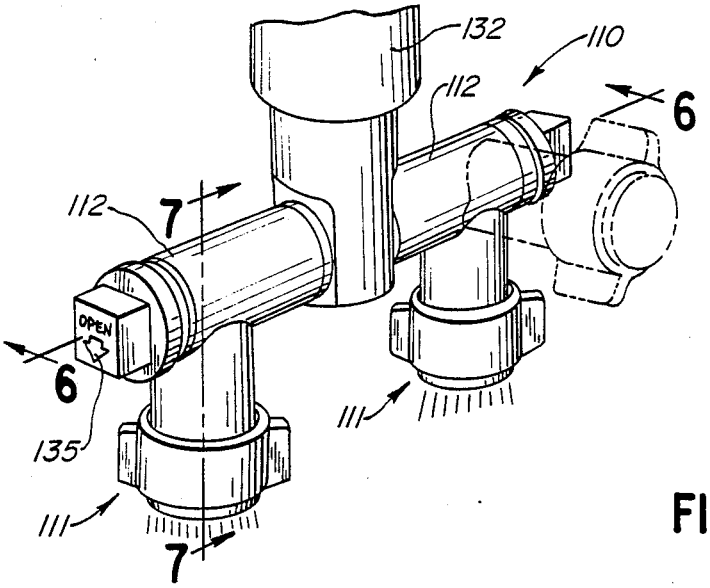
FIG. 5
FIG. 8
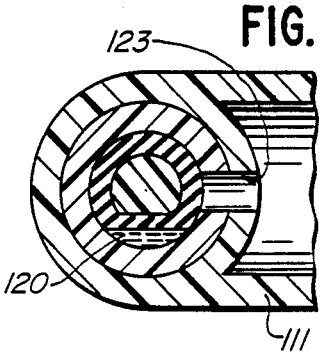
FIG. 7
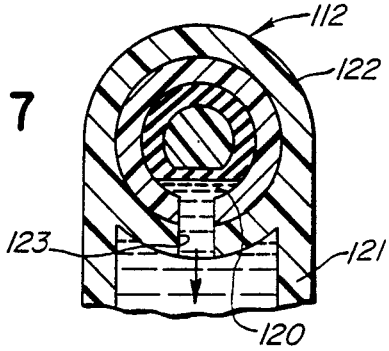
FIG. 6
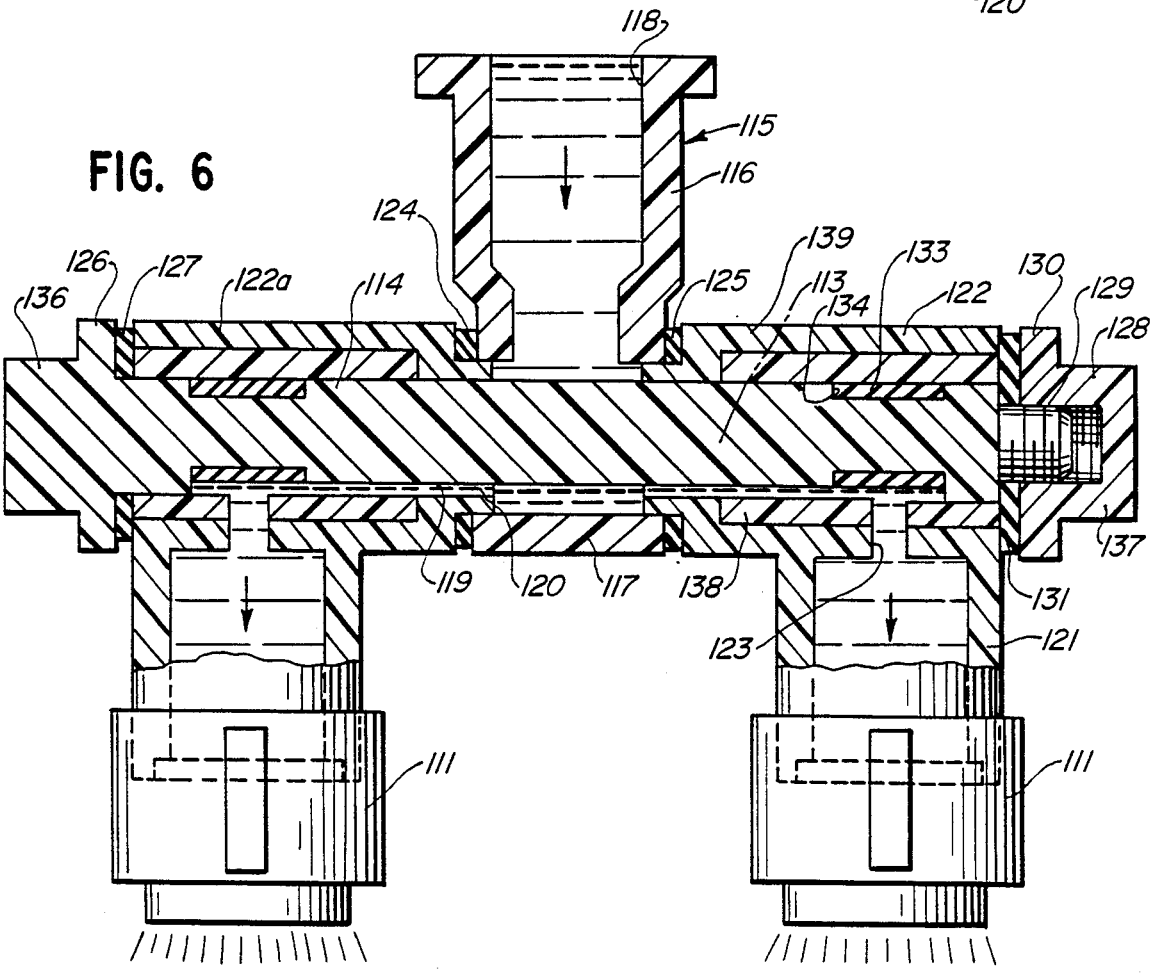

MISTING SYSTEM

TECHNICAL FIELD

This invention relates to misting systems and in particular to a misting head assembly for use in selectively providing misting spray such as on to subjacent produce.

BACKGROUND ART

One conventional form of misting head assembly for use in providing misting spray onto produce and the like comprises an assembly wherein the nozzles are in continuous open communication with the liquid supply inlet In such systems, prevention of the delivery cf the misting spray requires either that the delivery to the assembly be discontinued, or that the nozzles be removed and replaced with a closure plug, or the nozzles be removed, provided with a closure plug internally thereof, and reinstalled with the installed closure plug preventing further flow therethrough.

Such removal of the nozzles and/or disassembly thereof in effecting a selective discontinuation of misting spray delivery from the nozzles presents a serious problem in the possible loss of the nozzles and/or components of the assembly. Further the use of such shut off means is time consuming and costly.

DISCLOSURE OF THE INVENTION

The present invention comprehends a misting system having an improved misting head assembly permitting facilitated shutoff of selected misting heads as desired without the need for tools or possible loss of the components of the system.

More specifically, the invention comprehends the provision of such a misting head assembly including a cylindrical rotor defining a longitudinal axis and having a chordal flat, a center post having an inlet portion, an annular housing portion extending coaxially about said rotor, and a flow passage extending through the inlet portion and about said rotor, a nozzle for spraying water, a swivel arm having a tubular portion having a radial through opening and being mounted for swiveling movement about the axis of said rotor, and a connecting portion.

The assembly further includes means for mounting the nozzle to the swivel arm connecting portion. The rotor flat defines with the center post housing portion and the swivel arm tubular portion a longitudinal flow passage for conducting water from the center post inlet portion to the swivel arm radial through passage to sprayed outwardly therefrom through said nozzle when said swivel arm through opening is aligned with said chordal flat. Communication between the longitudinal flow passage and the swivel arm through opening is prevented when the swivel arm radial opening is positioned out of alignment with the chordal flat.

In a modified form, the assembly further includes sealing elements for movably sealing the swivel arm tubular portion to the rotor and the center post.

In the illustrated embodiments of the invention, the rotor includes an end portion having an end cap removably secured thereto to permit disassembly of the misting head assembly when desired.

In the illustrated embodiment, the rotor includes an outer surface portion formed of resilient sealing material adjacent the swivel arm through opening.

In the illustrated embodiment, the chordal flat extends approximately 90° about the rotor axis.

The invention further comprehends the provision in such structure of means for indicating the angular disposition of the swivel arm about the rotor axis wherein the radial through opening is aligned with the chordal flat for delivery of spray water thereto.

The sealing means in the modified embodiment includes a first annular seal means extending between the center post and the swivel arm and a second annular seal means extending between the rotor and the swivel arm.

The first annual seal means may extend coaxially between the center post and the swivel arm and the second annular seal means may extend radially between the rotor and swivel arm.

In the modified embodiment, the first annular seal means includes a first seal member extending coaxially between the swivel arm and the center post housing.

In the modified embodiment, the second seal member extends radially between the rotor and swivel arm tubular portion with a portion thereof exposed to the longitudinal flow passage.

In the modified embodiment, a second seal member extends between the rotor and the swim alarm tubular portion at a position spaced longitudinally outwardly from the flow passage.

The invention comprehends that a plurality of such nozzle and swivel arm subassembly structures be mounted for rotation about the rotor.

The misting head assembly of the present invention is extremely simple and economical of construction while yet providing the highly desirable features discussed above.

BRIEF DESCRIPTION OF THE DRAWINGS

FIG. 5 is a fragmentary perspective view of a modified embodiment of misting head assembly embodying the invention;

FIG. 6 is an enlarged longitudinal section thereof;

FIG. 7 is a fragmentary transverse section taken substantially along the line 7—7 of FIG. 5; and FIG. 8 is a fragmentary section illustrating the arrangement of the swivel arm for discontinuing flow of misting liquid through the spray nozzle.

BEST MODE FOR CARRYING OUT THE INVENTION

Figure 1:
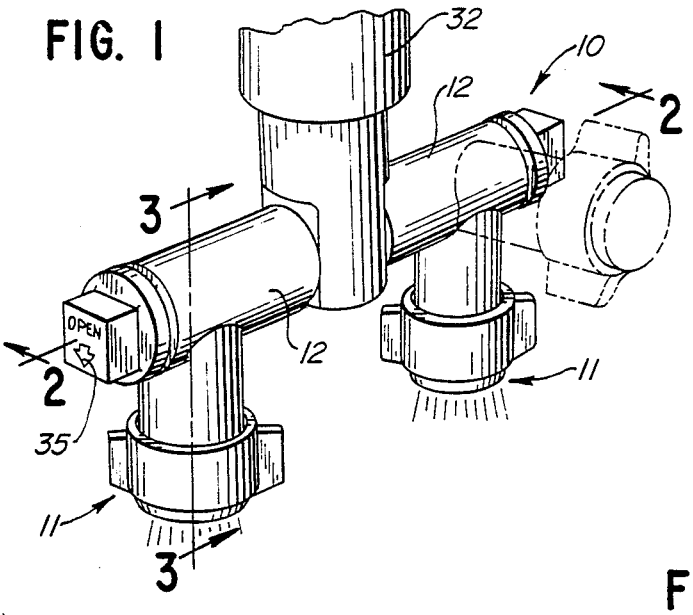
FIG. 1 is a fragmentary perspective view of a preferred embodiment of misting head assembly embodying the invention.
Figure 4:
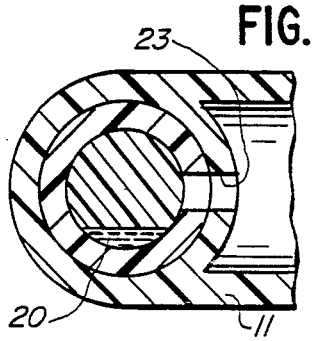
FIG. 4 is a fragmentary section illustrating the arrangement of the swivel arm for discontinuing flow of misting liquid through the spray nozzle.

In the illustrative embodiment of the invention as disclosed in FIGS. 1–4 of the drawings, a misting head assembly generally designated 10 is provided for use in providing misting spray such as water mist onto subjacent produce and the like. Assembly 10 includes a pair of spray nozzles generally designated 11 of conventional construction removably secured to a pair of swivel arms generally designated 12 forming a portion of the misting head assembly.

The swivel arms are mounted for coaxial swiveling thereof about the axis 13 of a cylindrical rotor 14.

A center post generally designated 15 includes a tubular inlet portion 16 and an annular housing portion 17 extending coaxially about the rotor. A flow passage 18 extends through the inlet portion 16 and about the rotor within the housing portion 17.

As shown, the cylindrical rotor 14 is provided with a chordal flat 19 which defines with the center post housing portion and the swivel arm tubular portion a longitudinally extending flow passage 20 for conducting water from flow passage 18 in the center post 15 to the swivel arm.

Figure 2:
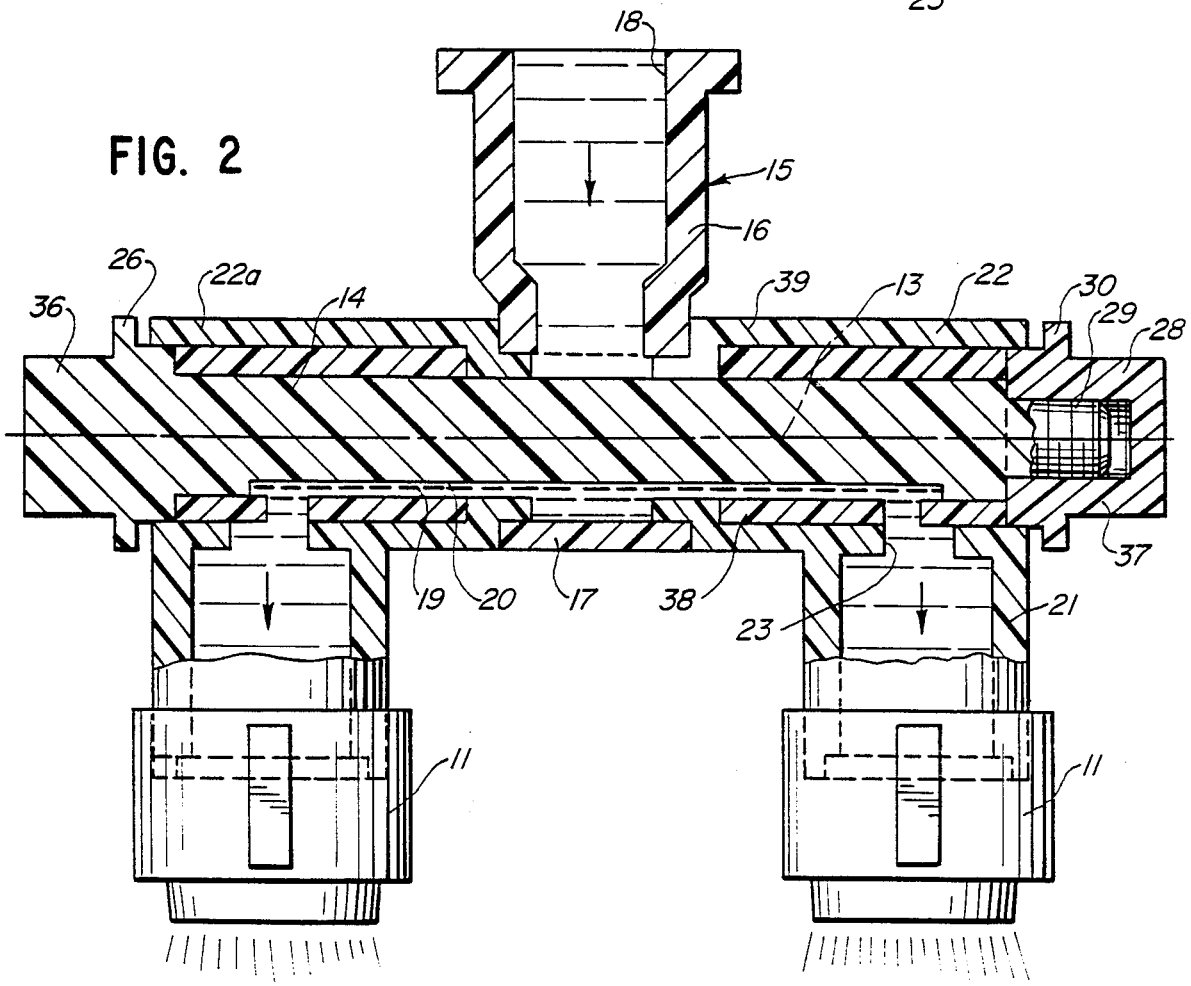
FIG. 2 is an enlarged longitudinal section thereof.

Each swivel arm includes a tubular connecting portion 21. As shown in FIG. 2, spray nozzles 11 may be removably mounted to the distal ends of the tubular portions 21.

The swivel arm further includes a tubular mounting portion 22 having a radial through opening 23. The mounting portion is mounted for swiveling movement about the axis 13 of the rotor.

Figure 3:
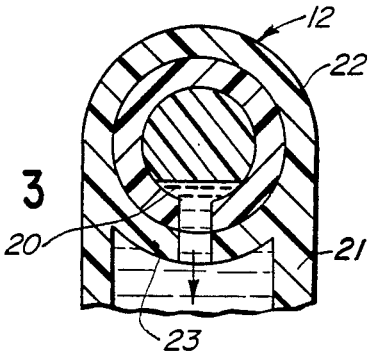
FIG. 3 is a fragmentary transverse section taken substantially along the line 3—3 of FIG. 1.

Flow passage 20 as shown in FIG. 2 is in communication with opening 23 of the swivel arm when the swivel arm is directed in a downwardly direction such as further illustrated in FIGS. 1 and 3. Thus water under pressure may flow through the center post, flow passage 20, through opening 23, and tubular portion 21 of the swivel arm to the spray nozzle 11 in such disposition of the swivel arm on the rotor.

As best seen in FIG. 2, center post 15 is movably coaxially sealed to the tubular mounting portion 22.

Rotor 14 defines an annual flange 26 at one end which is movably sealed to the end of the left-hand tubular mounting portion 22*a*. At the opposite end of the rotor, a cap 28 is threadedly mounted to a threaded end portion 29 of the rotor and defines an annular flange 30 which is movably sealed to the right-hand end of the tubular mounting portion 22. Resultingly, housing portion 17 of the center post is captured coaxially between the flanges 26 and 30. As shown in FIG. 1, center post 15 may be connected in fluid flow communication with a supply duct 32 so that in the spray delivery arrangement of FIG. 1, the nozzles 11 are directed generally downwardly.

As seen in FIGS. 2 and 3, communication is provided between the flow passage 20 and the through opening 23 so that spray water may be delivered to the spray heads 11 in the open arrangement of the assembly.

When it is desired to prevent delivery of spray from a selected spray head 11, the user merely swings the spray head from the downward disposition to a generally horizontal disposition as illustrated in broken lines in FIG. 1. As further illustrated in FIG. 4, the horizontal disposition of the spray head, or nozzle 11, removes the opening 23 from communication with the flow passage 20 thereby discontinuing further flow of the liquid from flow passage 20 to the spray head.

In effecting the swiveling of the spray head about the rotor, the user maintains the rotor in the disposition of FIG. 1 wherein an indicium 35 on the end portion 36 of the rotor indicates the downwardly open disposition of the nozzle. By so maintaining the rotor 14 against rotation about axis 13 the flow passage 20 is maintained in the downward disposition to cooperate with the selective positioning of the through opening 23 and defining the open and closed arrangements of the nozzle.

Cap 28 defines an end portion 37 in which an indicium (not shown) similar to indicium 35 may be provided so that proper disposition of the nozzles in the open position may be determined by observation of either end of the rotor.

The angular extent of the flow passage 20 about the axis 13 in the illustrated embodiment is approximately 90°. As will be obvious to those skilled in the art, this extension may be varied as desired. By providing a preselected angularity to the total extent of the flow passage about axis 13, a range of angularity to the true vertical may be provided in the open position of the nozzle.

As is further obvious to those skilled in the art, shutoff of the flow to the nozzle will occur when the nozzle is swung out of communication with the flow passage 20. This will occur at an angle to the vertical less than 90° in the embodiment illustrated in FIGS. 3 and 4. As will further be obvious to those skilled in the art, control of the rate of flow of the fluid to the nozzle from flow passage 20 may also be obtained by partial obstruction of the opening 23 in a disposition thereof intermediate the horizontal position of FIG. 4 and the vertical position of FIG. 3.

In the preferred assembly embodiment 10, tubular mounting portion 22 of the swivel arm includes an inner annular bushing portion 38 received within an outer annular enclosure portion 39. As will be obvious to those skilled in the art, the tubular mounting portion 22 may be formed as a one-piece element within the broad scope in the invention.

In the modified embodiment of the invention as disclosed in FIGS. 5–8 of the drawing, a misting head assembly generally designated 110 is provided for use in providing misting spray such as water mist onto subjacent produce and the like. Assembly 110 includes a pair of spray nozzles generally designated 111 of conventional construction removably secured to a pair of swivel arms generally designated 112 forming a portion of the misting head assembly.

The swivel arms are mounted for coaxial swiveling thereof about the axis 113 of a cylindrical rotor 114.

A center post generally designated 115 includes a tubular inlet portion 116 and an annular housing portion 117 extending coaxially about the rotor. A flow passage 118 extends through the inlet portion 16 and about the rotor within the housing portion 117.

As shown, the cylindrical rotor 114 is provided with a chordal flat 119 which defines with the center post housing portion and the swivel arm tubular portion a longitudinally extending flow passage 120 for conducting water from flow passage 118 in the center post 115 to the swivel arm.

Each swivel arm includes a tubular portion 121. As shown in FIG. 6, spray nozzles 111 may be removably mounted to the distal ends of the tubular portions 121.

The swivel arm further includes a tubular mounting portion 122 having a radial through opening 123. The mounting portion is mounted for swiveling movement about the axis 113 of the rotor.

Flow passage 120, as shown in FIG. 6, is in communication with opening 123 of the swivel arm when the swivel arm is directed in a downwardly direction such as further illustrated in FIGS. 5 and 7. Thus, water under pressure may flow through the center post, flow passage 120, through opening 123, and tubular portion 121 of the swivel arm to the spray nozzle 111 in such disposition of the swivel arm on the rotor.

As best seen in FIG. 6, center post 115 is movably coaxially sealed to the tubular mounting portion 122 by a pair of annular seals 124 and 125.

Rotor 114 defines an annual flange 126 at one end which is movably sealed to the end of the left-hand tubular mounting portion 122*a* by an annular seal 127. At the opposite end of the rotor, a cap 128 is threadedly mounted to a threaded end portion 129 of the rotor and defines an annular flange 130 which is movably sealed to the right-hand end of the tubular mounting portion 122 by an annular seal 131. Resultingly, housing portion 117 of the center post is captured coaxially between the flanges 126 and 130. As shown in FIG. 5, center post 115 may be connected in fluid flow communication with a supply duct 132 so that in the spray delivery arrangement of FIG. 5, the nozzles 111 are directed generally downwardly.

As seen in FIGS. 6 and 7, communication is provided between the flow passage 120 and the through opening 123 so that spray water may be delivered to the spray heads 111 in the open arrangement of the assembly.

When it is desired to prevent delivery of spray from a selected spray head 111, the user merely swings the spray head from the downward disposition to a generally horizontal disposition, as illustrated in broken lines in FIG. 5. As further illustrated in FIG. 8, the horizontal disposition of the spray head, or nozzle, 111 removes the opening 123 from communication with the flow passage 120, thereby discontinuing further flow of the liquid from flow passage 120 to the spray head. As shown, an annular seal 133 is provided in a suitable annular groove 134 in the rotor 114 in alignment with the spray head opening 123 so as to sealingly close the through opening 123 in the closed position of the assembly illustrated in FIG. 8.

As will be obvious to those skilled in the art, the seals 124, 125, 127, 131 and 133 further provide frictional retention of the nozzles 111 in the open and closed positions illustrated in FIGS. 7 and 8 while yet permitting ready manual positioning thereof as desired by the user.

In effecting the swiveling of the spray head about the rotor, the user maintains the rotor in the disposition of FIG. 5 wherein an indicium 135 on the end portion 136 of the rotor indicates the downwardly open disposition of the nozzle. By so maintaining the rotor 114 against rotation about axis 113, the flow passage 120 is maintained in the downward disposition to cooperate with the selective positioning of the through opening 123 and defining the open and closed arrangements of the nozzle.

Cap 128 defines an end portion 137 in which an indicium (not shown) similar to indicium 135 may be provided so that proper disposition of the nozzles in the open position may be determined by observation of either end of the rotor.

The angular extent of the flow passage 120 about the axis 113 in the illustrated embodiment is approximately 90°. As will be obvious to those skilled in the art, this extension may be varied as desired. By providing a preselected angularity to the total extent of the flow passage about axis 113, a range of angularity to the true vertical may be provided in the open position of the nozzle.

As is further obvious to those skilled in the art, shutoff of the flow to the nozzle will occur when the nozzle is swung out of communication with the flow passage 120. This will occur at an angle to the vertical less than 90° in the embodiment illustrated in FIGS. 7 and 8. As will further be obvious to those skilled in the art, control of the rate of flow of the fluid to the nozzle from flow passage 120 may also be obtained by partial obstruction of the opening 123 in a disposition thereof intermediate the horizontal position of FIG. 8 and the vertical position of FIG. 7.

In the modified embodiment, the tubular portion 122 includes an inner annular bushing portion 138 received within an outer annular enclosure portion 139. The bushing portion is formed of a resilient material. As will be obvious to those skilled in the art, the tubular portion 122 may be formed as a one piece element within the broad scope in the invention.

The sealing action and frictional movement retardation effected by the seals 124, 125, 127 and 131 may be controlled by the threaded adjustment of cap 128 on the threaded end portion 129 of rotor 114. Thus, maintained sealing and frictional retention forces may be obtained over a long, troublefree life of the assembly.

The misting head assemblies 10 and 110 are extremely simple and economical of construction while yet providing for facilitated shutoff of the spray selectively at different ones of the spray heads, or nozzles, of the assembly. Where maintenance of the structure is desired, the entire assembly may be readily disassembled by unthreading cap 28/128 from the threaded end 29/129 of the rotor and then axially withdrawing the rotor from the tubular housing portions 22/122. Where servicing of the nozzles 11/111 is desired without disassembling the entire unit, the nozzles may be unthreaded from the mounting portion 21/121 of the tubular element 22/122.

The seals and sealing bands 133 of the modified embodiment may be formed of any suitable sealing material, such as rubber. The other elements of the assembly are preferably formed of a molded synthetic resin as shown.

The foregoing disclosure of specific embodiments is illustrative of the broad inventive concepts comprehended by the invention.

I claim:

1. A misting head assembly comprising:

a cylindrical rotor defining a longitudinal axis and having a chordal flat;

a center post having an inlet portion, an annular housing portion extending coaxially about said rotor, and a flow passage extending through said inlet portion and about said rotor;

a swivel arm having a tubular portion having a radial through opening and being mounted for independent swiveling movement about the axis of said rotor and with respect to said center post, and a connecting portion; and means for mounting a misting spray nozzle to said swivel arm connecting portion, said rotor flat defining with said center post housing portion and said swivel arm tubular portion a longitudinal flow passage for conducting water from said center post inlet portion to said swivel arm radial through opening to be sprayed outwardly therefrom through the nozzle when said swivel arm through opening is aligned with said chordal flat, communication between said longitudinal flow passage and said swivel arm through opening being prevented when said swivel arm radial opening is positioned out of alignment with said chordal flat, said swivel arm tubular portion being movably sealed to said rotor and said center post.

2. The misting head assembly of claim 1 wherein said rotor includes an end portion having an end cap removably secured thereto to permit disassembly of the misting head assembly when desired.

3. The misting head assembly of claim 1 wherein said rotor includes an end portion having an end cap threaded thereto to permit disassembly of the misting head assembly when desired.

4. The misting head assembly of claim 1 includes said rotor outer surface portion formed of resilient sealing material adjacent said swivel arm through opening.

5. The misting head assembly of claim 1 includes said rotor outer surface portion formed of rubber adjacent said swivel arm through opening.

6. The misting head assembly of claim 1 wherein said chordal flat extends approximately 90° about said rotor axis.

7. The misting head assembly of claim 1 further including means thereon for indicating the angular disposition of the swivel arm about said rotor axis wherein said radial through opening is aligned with said chordal flat.

8. The misting head assembly of claim 1 further including means on said rotor for indicating the angular disposition of the swivel arm about said rotor axis wherein said radial through opening is aligned with said chordal flat.

9. The misting head assembly of claim 1 including at least two of said claimed nozzle and swivel arm structures mounted for rotation about said rotor.

10. The misting head assembly of claim 1 including at least two of said claimed nozzle and swivel arm structures disposed one each at longitudinally opposite sides of said center post housing portion.

11. A misting head assembly comprising:

a cylindrical rotor defining a longitudinal axis and having a chordal flat;

a center post having an inlet portion, an annular housing portion extending coaxially about said rotor, and a flow passage extending through said inlet portion and about said rotor;

a swivel arm having a tubular portion having a radial through opening and being mounted for independent swiveling movement about the axis of said rotor and with respect to said center post, and a connecting portion;

means for mounting a misting spray nozzle to said swivel arm connecting portion, said rotor flat defining with said center post housing portion and said swivel arm tubular portion a longitudinal flow passage for conducting water from said center post inlet portion to said swivel arm radial through opening to be sprayed outwardly therefrom through the nozzle when said swivel arm through opening is aligned with said chordal flat, communication between said longitudinal flow passage and said swivel arm through opening being prevented when said swivel arm radial opening is positioned out of alignment with said chordal flat; and means for movably sealing said swivel arm tubular portion to said rotor and said center post including first annular seal means extending between said center post and said swivel arm and second annular seal means extending between said rotor and said swivel arm.

12. The misting head assembly of claim 11 wherein said first annular seal means extend coaxially between said center post and said swivel arm.

13. The misting head assembly of claim 11 wherein said second annular seal means extend radially between said rotor and said swivel arm.

14. The misting head of claim 11 wherein said first annular seal means includes a first seal member extending coaxially between said swivel arm and second center post housing.

15. The misting head assembly of claim 11 wherein said first annular seal means includes a first seal member extending coaxially between said swivel arm and second center post housing and a second seal member extending radially between said rotor and said swivel arm tubular portion with a portion thereof exposed to said longitudinal flow passage.

16. The misting head assembly of claim 11 wherein said first annular seal means includes a first seal member extending coaxially between said swivel arm and second center post housing and a second seal member extending between said rotor and said swivel arm tubular portion at a position spaced longitudinally outwardly from said flow passage.

17. The misting head assembly of claim 11 including at least two of said claimed nozzle and swivel arm structures mounted for rotation about said rotor.

18. The misting head assembly of claim 11 including at least two of said claimed nozzle and swivel arm structures disposed one each at longitudinally opposite sides of said center post housing portion.

19. A misting head assembly comprising:

a cylindrical rotor defining a longitudinal axis and having a chordal flat;

a center post having an inlet portion, an annular housing portion extending coaxially about said rotor and a flow passage extending through said inlet portion and about said rotor;

a swivel arm having a tubular mounting portion having a radial through opening and being mounted for independent coaxial swiveling movement about the axis of said rotor and with respect to said center post, and a connecting portion;

means for mounting a misting spray nozzle to said swivel arm connecting portion, said rotor flat defining with said center post housing portion and said swivel arm tubular portion a longitudinal flow passage for conducting water from said center post inlet portion to said swivel arm radial through opening to be sprayed outwardly therefrom through the nozzle when said swivel arm through opening is aligned with said chordal flat, communication between said longitudinal flow passage and said swivel arm through opening being prevented when said swivel arm radial opening is positioned out of alignment with said chordal flat; and means for movably sealing said swivel arm tubular mounting portion to said rotor including a resilient tubular bushing between said rotor and said swivel arm.

20. The misting head assembly of claim 19 wherein said bushing extends radially between said rotor and said swivel arm mounting portion.

21. A misting head assembly comprising:

a cylindrical rotor defining a longitudinal axis and having a chordal flat and an annular circumferential groove;

a center post having an inlet portion, an annular housing portion extending coaxially about said rotor and a flow passage extending through said inlet portion and about said rotor;

a swivel arm having a tubular mounting portion having a radial through opening and being mounted for independent coaxial swiveling movement about the axis of said rotor and with respect to said center post, and a connecting portion;

means for mounting a misting spray nozzle to said swivel arm connecting portion, said rotor flat defining with said center post housing portion and said swivel arm tubular portion a longitudinal flow passage for conducting water from said center post inlet portion to said swivel arm radial through opening to be sprayed outwardly therefrom through the nozzle when said swivel arm through opening is aligned with said chordal flat, communication between said longitudinal flow passage and said swivel arm through opening being prevented when said swivel arm radial opening is positioned out of alignment with said chordal flat; and a resilient annular seal disposed coaxially in said rotor groove and sealingly engaging said mounting portion of the swivel arm.

22. The misting head assembly of claim 21 wherein said annular seal comprises a tubular band.

23. The misting head assembly of claim 21 wherein said annular seal comprises a tubular band formed of rubber.

* * * * *